United States Patent [19]

Dombrowsky

[11] 4,287,385

[45] Sep. 1, 1981

[54] SHIELDED FLAT CABLE

[75] Inventor: Donald S. Dombrowsky, Spring Valley, N.Y.

[73] Assignee: Carlisle Corporation, Buchanan, N.Y.

[21] Appl. No.: 75,154

[22] Filed: Sep. 12, 1979

[51] Int. Cl.[3] ..... H01B 7/20

[52] U.S. Cl. ..... 174/36; 174/105 R; 174/117 F

[58] Field of Search ..... 174/32, 36, 102 R, 105 R, 174/117 F, 117 FF

[56] References Cited

U.S. PATENT DOCUMENTS

| | | | |
|---|---|---|---|
| 1,746,299 | 2/1930 | Berry | 174/102 D |
| 3,082,292 | 3/1963 | Gore | 174/117 F |
| 3,612,743 | 10/1970 | Angele | 174/117 FF |
| 3,634,782 | 1/1972 | Marshall | 174/117 F X |
| 3,663,739 | 5/1972 | Chevrier | 174/117 F X |
| 3,703,604 | 11/1972 | Henschen | 174/117 FF X |
| 3,757,029 | 9/1973 | Marshall | 174/36 |
| 3,941,966 | 3/1976 | Schatz | 174/117 F X |

FOREIGN PATENT DOCUMENTS

| | | | |
|---|---|---|---|
| 2754342 | 6/1979 | Fed. Rep. of Germany | 174/117 F |

OTHER PUBLICATIONS

"Controlled Impedance CIP Flat Cables", Tensolite Carlisle Bull. #119C, 10/78 by Tensolite, Co., Torrance, Calif. 90502.

*Primary Examiner*—Richard R. Kucia
*Attorney, Agent, or Firm*—Brooks, Haidt, Haffner & Delahunty

[57] ABSTRACT

Shielded flat cable having low cross talk, low propagation delay and high propagation velocity including flat multiconductor cable core with convoluted surfaces, flat spacer strips trapping air in the cable surface convolutions and conductive sheathing held away from the cable core by the spacers.

4 Claims, 5 Drawing Figures

FIG. 1
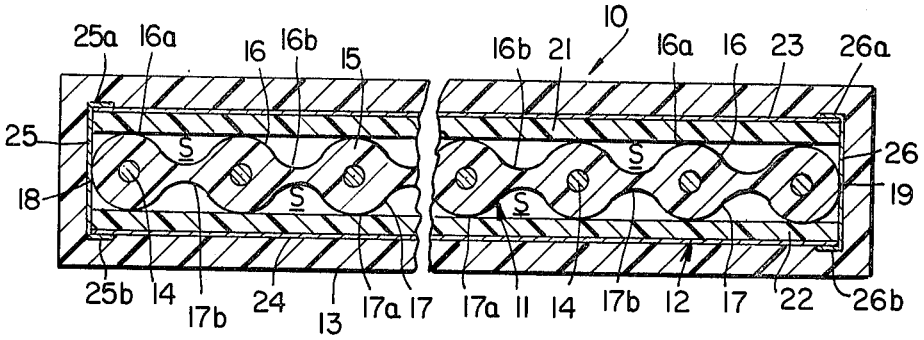
FIG. 2
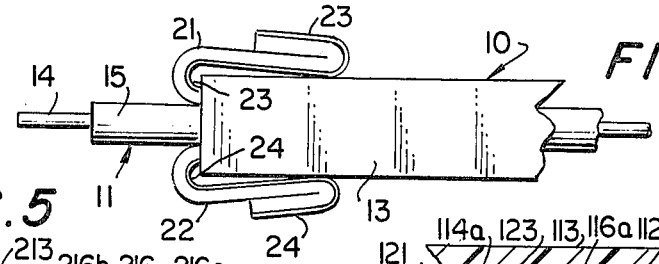
FIG. 5
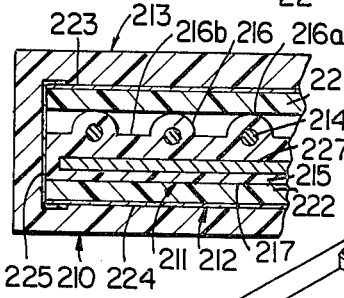
FIG. 4
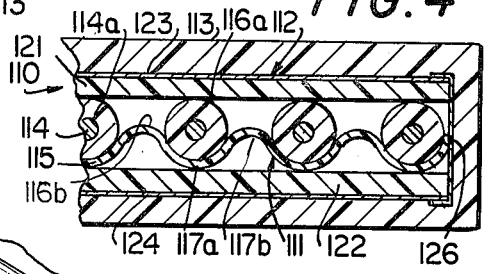
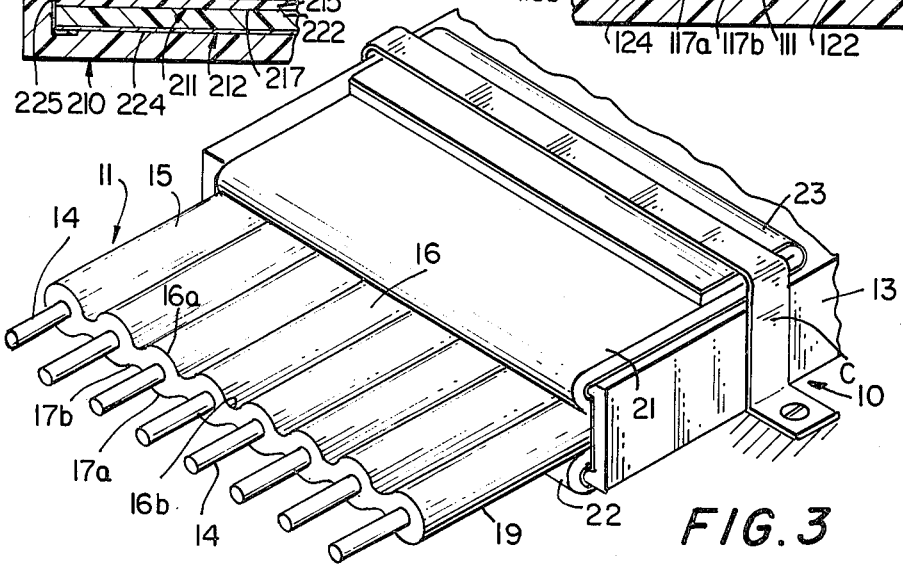
FIG. 3

SHIELDED FLAT CABLE

This invention relates to electric cable and in particular provides a novel shielded flat cable construction useful as transmission line, for example, in computer back plane wiring and connection to peripherals.

Flat electric cable has gained widespread acceptance in the computer industry, at least in part because a flat configuration facilitates connection of a multiplicity of parallel circuits without the necessity of coding each conductor, particularly when using flat connectors with contact spacing designed to accommodate the conductor spacing of the flat cable. Flat cable is also less bulky and inherently more flexible than electrically equivalent cable constructed of harnessed individually insulated conductors (hereinafter "harness cable").

As computer speeds have increased into the multiple megahertz range, impedance of cabled transmission lines has become critical and cross talk has presented problems in flat cable, as well as in conventional harness cable. These problems can be handled by utilizing round coaxial and twisted pair constructions in harness cable, but compactness and flexibility are sacrificed, as well as the convenience of flat cable configuration.

As a consequence, various alternative electrical shielding constructions have been proposed in an effort to minimize cross talk while retaining the benefits of flat cable configuration. Early proposals involved utilizing alternate conductors in the flat cable as ground (logic zero) conductors, thus isolating signal carrying conductors between grounds. A variation of this construction involves making every third conductor across the cable a signal carrying conductor such that there ae two ground carrying conductors between each adjacent pair of signal carrying conductors. Another proposed solution to the cross talk problem in flat multiconductor cables was the employment of a ground plane conductor adjacent to the cable and having a width approximating that of the cable.

As the operating speeds of computors increased these proposed solutions to the cross talk problem were supplanted by more sophisticated approaches that enabled better control of impedance, reduced cross talk and better flexibility than, for example, was obtained with a wide ground plane construction. Such solutions having included multi-layer constructions with ground and signal carrying conductors aligned in various configurations. Multi-layer constructions, however, present a serious problem of correct alignment and do not completely mitigate the problem of cross talk. Consequently, the ultimate solution to the cross talk problem in flat, electric cable involves total enclosure with an electrical shield in combination with the use of alternate ground conductors, or the like, to provide substantial isolation of each signal carrying conductor from the others and from the environment.

The standard method for providing such total shielding heretofore has been by applying shielding such as braided shielding about an existing unshielded flat cable component as a core. The impedance shift caused by the proximity of the shield to the signal and ground conductors, however, is excessive. Time domain reflectometry of such shielded cables exhibits severe skewing and distortion of the expected wave shape.

In accordance with this invention standard flat cable components can be provided with total enclosure by electrical shielding without substantial impedance shift while obtaining substantial elimination of backward cross talk and significant reduction in forward cross talk. This is accomplished utilizing cable cores which are flat multi-conductor electric cable components in which the body of solid dielectric material serving to retain and insulate the conductors has its parallel wide faces ribbed, i.e., convoluted about the conductors providing alternate lands and grooves running the length of the cable. Flat spacer strips of solid dielectric material are positioned one on each face of the cable dielectric body abutting the lands, so that the spacer strips function to trap air as a dielectric between the lands in the grooves (and hence between the conductors as the conductors are positioned between lands in opposite faces of the cable core). The electrical shield enclosing the cable component is completed with a sheath of electrically conductive metal positioned about the cable core including the spacer strips. It has been found by thus spacing the sheath of conductive material away from the cable core with the inclusion of air-dielectric adjacent cable core that backward cross talk can be reduced virtually to zero and forward cross talk can be reduced to approximately 2 to 4% when the shield (sheath of conductive material) is at logic zero.

Normal practice dictates that jacketing and electrical shielding about a cable be terminated as the cable enters a computer. In accordance with this invention the cable core can be continued into the computer from the terminated shielding without change as the electrical specifications of the core in air remain unchanged from those of the shielded cable. In other words, such parameters as impedance of the shielded cable match the same parameters of the core. In some circumstances the use of a ground plane conductor is required within the computer. In accordance with this invention electrical shielding can be utilized with a flat cable core having a ground plane conductor without change in the electrical specifications of the core in air as compared with the specifications of the shielded cable.

For a more complete understanding of the practical application of the principles of this invention, reference is made to the appended drawings in which:

FIG. 1 is a cross-section through a flat multi-conductor electric cable which has electrical shielding in accordance with this invention;

FIG. 2 is a fragmentary edge view of an end of electric cable shown in FIG. 1 which has been prepared for termination;

FIG. 3 is a perspective view showing a cable end, as shown in FIG. 2, which has been terminated to provide grounding of the electrical shielding;

FIG. 4 is a fragmentary view of a cross-section similar to FIG. 1 illustrating a variation in cable core construction; and FIG. 5 is a fragmentary view of a cross-section similar to that of FIG. 4 illustrating another variation in cable core construction.

Referring to FIGS. 1, 2, and 3 of the drawings the reference numeral 10 generally designates a shielded flat electric cable in accordance with this invention. Cable 10 has a core 11, which is an unshielded flat multi-conductor cable, an electrical shield assembly 12 and an outer protective jacket 13.

Core 11 is composed of a plurality of conductors 14 which are disposed lengthwise of core 11 in a parallel and coplanar configuration and in the illustrated case are equally spaced from each other along the length of core 11. Conductors 14 are retained in such parallel and coplanar configuration and are insulated from each other and the exterior by a body 15 of solid dielectric material in which conductors 14 are embedded. Body 15 is ribbed lengthwise of core 11 in that the dielectric material is convoluted about conducutors 14. Thus dielectric body 15 has a pair of opposite wide faces 16 and 17, extending the length of cable core 11, which are marginally joined together forming a pair of opposing edges 18 and 19 on body 15. Faces 16 and 17 have a plurality of lands 16*a* and 17*a*, respectively, and a plurality of grooves 16*b* and 17*b*, respectively, alternately disposed and running lengthwise of cable core 11 to give it a ribbed appearance. Lands 16*a* and 17*a* are disposed opposite each other and are adjacent conductors 14, whereas grooves 16*b* and 17*b*, although also disposed opposite each other are located between conductors 14.

A typical such unshielded flat cable, such as is used in the computer industry and is used herein as a cable core 11, can have from relatively few, i.e., less than ten up to a hundred or more, conductors. The conductors can be spaced as closely as 25 mils. center to center and can be single or multiple stranded, bare copper, tinned copper or silver plated copper, typically from 20 to 36 AWG. The thickness of core 11 between lands 16*a* and 17*a* can be typically from 0.025 inch to 0.1 inch while the thickness of core 11 between opposing grooves 16*b* and 17*b* can be typically from one fifth to one half the thickness between lands 16*a* and 17*a* i.e., from about 0.005 to about 0.05 inches.

The dielectric body 15 of core 11 typically is thermoplastic solid dielectric material such as polyolefin, olefin copolymers, polyvinyl chloride and the like, and is preferably manufactured by laminating two sheets of the dielectric about conductors positioned in the desired configuration and bonding the sheets together. The method of manufacture of core 11 and the dielectric utilized in body 15 are, however, not critical and can by any of those conventionally used in the manufacture of flat cable consistent with the electrical and physical specifications required. (One specialized variation in the construction of the cable core is described below with reference to FIG. 4).

In accordance with this invention electrical shielding assembly 12 is applied to cable core 11 preferably at the same time as jacket 13 is applied. Shielding assembly 12 in this case, includes a pair of flat elongated strips 21 and 22 of solid dielectric material having a width approximating that of core 11 which are positioned on opposite sides of body 11 aligned therewith and abutting lands 16*a* and 17*a*, respectively. Spaces S are thus formed between each strip 21 and 22 and core 11 in the grooves 16*b* and 17*b*, respectively, located between each adjacent pair of lands 16*a*, 16*a* and 17*a*, 17*a* respectively, in which air is trapped.

Strips 21 and 22 on their surfaces facing away from core 11 have adherent films 23 and 24, respectively, of conductive metal, such as aluminum formed by cathode sputtering, vacuum metallizing or other similar techniques. Films 23 and 24 can also be sheets of foil bonded by adhesive to strips 21 and 22, respectively.

Electrical shield assembly 12 is completed by a pair of channel shaped strips 25 and 26 of conductive metal, such as aluminum foil, positioned butting the edges 18 and 19, respectively, of dielectric body 15 and extending lengthwise of body 15 with flanged portions 25*a* and 26*a*, and 25*b* and 26*b* overlying the marginal edges of adherent metal strips 23 and 24, respectively, such that strips 23, 24, 25 and 26 form a complete metal enclosure, i.e., a sheath, about core 11 and strips 21 and 22. Preferably the thickness of films 23 and 24 and edge channels 25 and 26 is on the order of at least 2 mils in order to provide proper drainage of any static build-up on core 11.

Strips 21 and 22 with their respective adherent films 23 and 24 and edge channels 25 and 26 are assembled about core 11 and fed with it through an extruder which applies jacket 13 also of solid dielectric material.

A commercial cable core component 11 having forty AWG #28 tinned copper conductors 14 of stranded (7/36) construction spaced on 50 mil centers in polyvinyle chloride insulation forming body 15 with a land-to-land thickness of 0.034 inches and overall width of 2.000 inches has an impedance of 100 ohms, a propagation delay of 1.41 ns/ft and a velocity of propagation equal to 72% nominal. When this cable is shielded by direct application of conductive shielding to the surface of the cable the impedance shift causes a change in propagation delay up to 1.56 ns/ft which exceeds standard tolerences and may in fact inhibit certain functions from being properly performed during data transmission of bits through the cables. When the same cable core 11 is shielded in accordance with this invention by spacers 21 and 22 having dimensions of 2 inches in width and 10 mils in thickness made of polyvinyl chloride and having 2 mil thick layers of aluminum 23 and 24 on their outer sides and edge shields 25 and 26 having dimensions of 2 mils by 0.4375 inches held in place over core 11 by a jacket 13 of polyvinyl chloride having a 0.035 inch nominal wall thickness, the impedance of the resultant shielded cable 10 is 86 ohms and the propagation delay is 1.40 ns/ft with a propagation velocity of 72.6% nominal. These changes from the electrical specifications of the original core component 11 are barely beyond the manufacturing tolerances for such core component.

One serendipitous advantage of a shielded cable in accordance with this invention is the ease with which the cable can be terminated. Referring to FIGS. 2 and 3 it can be seen that in terminating the cable, jacket 13 ca be cut back to expose a length of the underlying spacers 21 and 22 and core 11 at the end of the cable to be terminated. Aluminum edge pieces 18 and 19 are readily removed and cut away up to the cut end of jacket 13, and spacers 21 and 22 can be folded back upon jacket 13 and then upon themselves to expose aluminum layers 23 and 24 outwardly which can then be conveniently placed under a ground clamp of a conventional connector to provide a mechanically and electrically sound ground for the shielding. The individual conductors 14 are terminated in the connector in a conventional manner.

Referring to FIG. 4 the reference numeral 110 designates a shielded multiconductor flat cable in accordance with the present invention which has a flat cable core component 111 provided with electrical shielding 112 and outer protective jacket 113.

Cable core 111 has a plurality of conductors 114 disposed parallel to each other and in a common plane which are individually provided with primary insulation 114*a*, for example, by extrusion of polyvinyl chloride insulation. Conductors 114 are retained in parallel and coplanar configuration by means of a thermoplastic web 115 of material, such as polyvinyl chloride, which is firmly bonded by heat to the primary insulation 114*a* of conductors 114 on one side of conductors 114 and is convoluted about such primary insulation that web 115 and conductor insulation 114*a* are firmly bonded together to form a unified structure in which conductors 114 are embedded. The exposed surfaces of insulation 114*a* forming a series of lands 116*a* on one side of cable 111 which alternate with grooves 116*b* formed between conductors 114 where web 115 is exposed. Web 115 on the other side of conductors 114 similarly because of the convolution about the conductors forms a series of lands 117*a* adjacent conductors 114 which alternate with grooves 117*b* formed between conductors 114.

Cable core 111 is provided with electrical shielding in accordance with this invention substantially in the same manner as described with respect to cable core 11. The shielding assembly 112 is thus supplied to cable core 111, preferrably at the same time as jacket 113 is applied. Again the shielding assembly includes a pair of flat, elongated spacer strips 121 and 122 of solid dielectric material having a width approximating that of core 111 which are positioned on opposite sides of cable core 111 aligned therewith and abutting lands 116*a* and 117*a*, respectively. Spaces are thus formed between each strip 121 and 122 and core 111 in grooves 116*b* and 117*b*, respectively, located between each adjacent pair of lands 116*a*, 116*a* and 117*a*, 117*a* in which air is trapped. As before strips 121 and 122 on the surfaces facing away from core 111 have adherent films 123 and 124, respectively, of conductive metal, such as aluminum. Shield assembly 112 is completed by a pair of channel shapped strips 125 (not shown) and 126 of conductive metal, such as aluminum foil, which are assembled about core 111 together with strips 121 and 122 and fed with it through an extruder which applies jacket 113, typically of polyvinyl chloride material.

Shielded cable 110 has the same advantages of low cross talk, low propagation delay and high velocity of propagation described above. It is thus possible in accordance with this invention to provide the advantages of total electrical shielding (when adjacent pairs of signal carrying conductors are separated at least by one ground conductor) while minimizing any deleterious effect on the electrical properties of the cable.

As indicated above in some circumstances it is desirable to provide electrical shielding for a cable component externally of the computer when the cable requires a ground plane conductor when introduced into the computer. As the shielding must be terminated at the entrance to the computer, the impedance and other factors, such as propagation delay in the cable, when shielded externally of the computer should match the same electrical specifications of the unshielded cable component within the computer. This is readily accomplished in accordance with the present invention, when the internal cable components requires a ground plane conductor, utilizing the same cable having a ground plane conductor as a cable core component for the shielded cable located externally of the computer, as impedance, propagation delay and the like are substantially unaffected by electrical shielding in accordance with the present invention.

It will be understood that by ground plan conductor reference is made to a wide, flat conductive strip in a flat multiconductor cable typically spanning the width of the cable and positioned to one side of, and insulated from, a plurality of signal carrying conductors disposed in parallel and coplanar configuration which functions as a ground return for such signal carrying conductors. The ground plane conductor itself can be embedded in the same dielectric body in which the signal carrying conductors are embedded or it can be formed as a separate, individually insulated wide, flat conductor attached to a separate insulated body in which the signal carrying conductors are embedded.

Referring to FIG. 5 the reference numeral 210 refers to a shielded flat electric cable in accordance with this invention which has a cable core component 211 which is a flat multiconductor cable having a ground plane conductor 227.

Cable core component 211 is composed of a plurality of signal carrying conductors 214 which are disposed lengthwise of core component 211 in a parallel and coplanar configuration equally spaced from each other along the length 211. Conductors 214 are retained and insulated from each other in a dielectric body 215 of solid dielectric material in which ground plane conductor 227 is also embedded adjacent to and spaced from one side of conductors 214. Ground plane conductor 227 is itself a thin, flat strip of conductive material, such as copper, which has a span slightly wider than the span of conductors 214 collectively and, of course, extends the length of cable core 211.

Dielectric body 215 has a pair of parallel opposite faces 216 and 217, respectively adjacent conductors 214 and adjacent ground plane conductor 227. Face 216, as in the case of face 16 of the embodiment shown in FIG. 1 for example, is ribbed such that face 216 is formed with a plurality of lands 216*a* adjacent conductors 214 and a plurality of grooves 216*b* located intermediate conductors 214. In accordance with the present invention when ground plane conductor 227 is utilized, however, ribbing is unnecessary in face 217 adjacent ground plane conductor 227, and face 217 is flat.

In accordance with invention electrical shielding 212 is applied to cable core 211, preferably at the same time as a jacket 213 is extruded over the assembly. Shielding assembly 212 includes a pair of flat, elongated spacer strips 221 and 222 of solid dielectric material, having a width approximating that of core 211 and are positioned adjacent faces 216 and 217, respectively.

Strip 221 abuts lands 216*a* such that air is trapped in the space between lands 216*a*, grooves 216*b* and the inner face of strip 221. Spacer strip 222 abuts face 217 across its width and along the length of the cable.

Spacer strips 221 and 222 on their surfaces facing away from core 211 have adherent films 223 and 224, respectively, of conductive metal which form part of electrical shield assembly 212. Electrical shield assembly 212 is completed by a pair of channel shaped strips 225 and 226 (not shown) of conductive metal positioned abutting the edges of dielectric body 215 extending lengthwise of it with flanged portions overlying the marginal edges of adherent metal strips 223 and 224 to form a complete metal enclosure about core 211.

While ribbing of face 217 of dielectric body 215 housing ground plane conductor 227 is unnecessary, the employment of spacer 222 and the adherent strip 224 of conductive metal is necessary both to complete the total enclosure of cable core 211 with electrical shielding and to space such shielding away from ground plane conductor 227, as ground plane conductor 227 is not tied to shielding 212 but functions as a ground return for signal carrying conductors 214.

Thus, in accordance with this invention, it is possible to provide interconnection between a computer and peripheral equipment utilizing cable 210 connected at the entrance to the computer through a suitable connector to a cable located within the computer which is not shielded, but which is identical to cable core 211 having a ground plane conductor 227, without mismatch at the cable interconnection.

I claim:

1. Shielded flat electric cable comprising:

(a) a cable core including;

(i) a plurality of conductors of indefinite length spaced apart and disposed in parallel and coplanar configuration, (ii) a body of indefinite length of solid dielectric material having a pair of relatively wide parallel faces and a pair of relatively narrow, opposing edges joining said faces, said conductors being embedded lengthwise in said body and thereby retained in said spaced part, parallel and coplanar configuration insulated from each other and from the exterior of said cable core, and (iii) means defining a plurality of parallel lands and a plurality of parallel grooves alternately disposed in each said face lengthwise thereof with said grooves aligned between adjacent conductor locations in said core and said lands aligned adjacent said conductors; and (b) an electric shield assembly including (i) a pair of flat spacer strips of indefinite length of solid dielectric material positioned, one butting against each said face and extending lengthwise thereof thereby trapping air-dielectric in said grooves between said lands and said spacer strip, and (ii) a sheath of conductive metal enclosing said core and spacer strips, said sheath comprising a pair of thin conductive layers, one adhered to each said spacer strip on the surface thereof facing away from said cable core, and a pair of thin conductive channels, one positioned over each said edge of said body overlying the adjacent portions of said conductive layers on said spacer strips.

2. A shielded flat, electric cable according to claim 1 which further includes a jackwet of solid dielectric material enclosing said sheath.

3. A shielded flat, electric cable according to either claim 1, or claim 2 in which said sheath has sufficient thickness to drain static charges on said core.

4. Shielded flat electric cable comprising:

(a) a cable core including:

(i) a plurality of conductors of indefinite length spaced apart and disposed in parallel and coplanar configuration, (ii) a wide, flat conductive strip of indefinite length positioned adjacent one side of, space from and extending lengthwise of said plurality of conductors, (iii) solid dielectric means retaining said plurality of conductors in spaced apart, parallel and coplanar configuration insulated from each other and from the exteriors of said cable core and retaining said wide conductive strip adjacent said one side of and spaced from said plurality of conductors and insulated therefrom, (iv) means defining a face on said solid dielectric means parallel to and adjacent said conductors on the side thereof opposite said conductive strip including a plurality of parallel lands and a plurality of parallel grooves alternately disposed in said face lengthwise thereof with said grooves aligned between adjacent conductor locations in said core and said lands aligned adjacent said conductors; and (b) an electric shield assembly including (i) a flat spacer strip of indefinite length of solid dielectric material positioned abutting against said face and extending lengthwise thereof, thereby trapping air dielectric in said grooves between said lands and said spacer strip, (ii) a second spacer strip abutting the side of said dielectric means adjacent said conductive strip, and (iii) a sheath of conductive metal enclosing said core and spacer strips, said sheath comprising a pair of thin conductive layers, one adhered to each said spacer strip on the surface thereof facing away from said cable core, and a pair of thin conductive channels, one positioned over each said edge of said body overlying the adjacent portions of said conductive layers on said spacer strips.

* * * * *